US011173992B2

(12) United States Patent
Gruentzig

(10) Patent No.: US 11,173,992 B2
(45) Date of Patent: Nov. 16, 2021

(54) BUOYANCY GARMENT

(71) Applicant: Legionarius, LLC, Sudbury, MA (US)

(72) Inventor: Alexander Gruentzig, Sudbury, MA (US)

(73) Assignee: LEGIONARUS, LLC, Wilmington, DE (US)

( * ) Notice: Subject to any disclaimer, the term of this patent is extended or adjusted under 35 U.S.C. 154(b) by 349 days.

(21) Appl. No.: 16/226,744

(22) Filed: Dec. 20, 2018

(65) Prior Publication Data

US 2020/0023927 A1 Jan. 23, 2020

Related U.S. Application Data

(60) Provisional application No. 62/611,179, filed on Dec. 28, 2017.

(51) Int. Cl.
*B63C 9/18* (2006.01)
*B63C 9/105* (2006.01)

(52) U.S. Cl.
CPC ..... *B63C 9/1055* (2013.01); *B63C 9/18* (2013.01)

(58) Field of Classification Search
CPC ..... B63C 9/1055; B63C 9/18
See application file for complete search history.

(56) References Cited

U.S. PATENT DOCUMENTS 451,197 A 4/1891 Robare
1,042,314 A 10/1912 Brion
3,193,842 A 7/1965 Bell
3,933,150 A 1/1976 Kaplan et al.
5,090,053 A 2/1992 Hayes
5,195,752 A 3/1993 Reeves et al.
5,636,378 A * 6/1997 Griffith ..... A41D 13/015 2/102
5,867,842 A * 2/1999 Pinsley ..... A41D 13/018 2/462
6,012,162 A 1/2000 Bullat
6,032,299 A 3/2000 Welsh
6,042,147 A 3/2000 Nishijima et al.
(Continued)

FOREIGN PATENT DOCUMENTS

WO WO-92/13074 A1 8/1992
WO WO-2006/086402 A2 8/2006
(Continued)

OTHER PUBLICATIONS

International Search Report and Written Opinion for International Patent Application No. PCT/US2018/013665, dated May 25, 2018 (17 pages).
(Continued)

*Primary Examiner* — S. Joseph Morano
*Assistant Examiner* — Jovon E Hayes

(57) ABSTRACT

Described herein is a garment (e.g., pants, underpants, shorts, headgear, a skullcap, a glove, socks, shoes, a vest, a jacket, a shirt, an undershirt, an undergarment, or a full body suit) that can be worn by a wearer (e.g., military or civilian law enforcement personnel, an emergency first responder, or a dog) that includes inflatable bladders. When activated, the bladders of the garment inflate, thereby providing an increase in buoyancy to the wearer of the garment, e.g., while swimming.

39 Claims, 9 Drawing Sheets

(56) References Cited

U.S. PATENT DOCUMENTS

| | | | | |
|---|---|---|---|---|
| 6,349,201 | B1 * | 2/2002 | Ford | F41H 1/02 2/455 |
| 6,757,916 | B2 | 7/2004 | Mah et al. | |
| 6,939,314 | B2 | 9/2005 | Hall et al. | |
| 6,997,218 | B1 | 2/2006 | Garcia et al. | |
| 7,056,179 | B2 * | 6/2006 | Courtney | B63C 9/0005 441/90 |
| 7,288,011 | B2 * | 10/2007 | Ganley | B63C 9/1255 441/106 |
| 7,329,792 | B2 | 2/2008 | Buckman et al. | |
| 7,548,168 | B2 | 6/2009 | Ishikawa et al. | |
| D596,829 | S | 7/2009 | Miller | |
| 7,921,472 | B2 | 4/2011 | Mazzarolo | |
| 8,079,247 | B2 | 12/2011 | Russell et al. | |
| 8,231,421 | B1 * | 7/2012 | Hubbard | A41D 13/0125 441/92 |
| 8,591,275 | B2 * | 11/2013 | Gonsalves | B63C 9/115 441/106 |
| D743,146 | S | 11/2015 | Yerby | |
| 9,242,093 | B1 | 1/2016 | Sherman | |
| D775,786 | S | 1/2017 | Trabert | |
| D905,935 | S | 12/2020 | Gruentzig | |
| 10,874,152 | B2 | 12/2020 | Gruentzig | |
| 2005/0067816 | A1 | 3/2005 | Buckman | |
| 2007/0061941 | A1 | 3/2007 | Makabe et al. | |
| 2008/0105114 | A1 | 5/2008 | Gabrys | |
| 2010/0083733 | A1 * | 4/2010 | Russell | A41H 1/02 73/12.01 |
| 2011/0204114 | A1 | 8/2011 | Miller | |
| 2012/0060260 | A1 | 3/2012 | Kochling | |
| 2012/0102630 | A1 | 5/2012 | Anderson | |
| 2012/0118449 | A1 | 5/2012 | Barnes et al. | |
| 2012/0144934 | A1 | 6/2012 | Russell et al. | |
| 2012/0180179 | A1 | 7/2012 | Lee et al. | |
| 2012/0246788 | A1 | 10/2012 | Harrell et al. | |
| 2013/0058906 | A1 | 3/2013 | Turzi | |
| 2013/0131566 | A1 | 5/2013 | Bodansky | |
| 2013/0210297 | A1 * | 8/2013 | Maas | B63C 9/19 441/95 |
| 2014/0023579 | A1 | 1/2014 | van Vliet et al. | |
| 2014/0236221 | A1 | 8/2014 | Zhadkevich | |
| 2015/0173433 | A1 * | 6/2015 | Mazzarolo | A41D 13/018 2/461 |
| 2015/0374060 | A1 | 12/2015 | Morgan | |
| 2016/0008206 | A1 | 1/2016 | Devanaboyina | |
| 2017/0049164 | A1 * | 2/2017 | Gruentzig | A41D 1/002 |
| 2017/0193858 | A1 | 7/2017 | Segall | |
| 2019/0069623 | A1 | 3/2019 | Kuntz | |
| 2019/0208841 | A1 | 7/2019 | Gruentzig | |
| 2020/0247513 | A1 * | 8/2020 | Garner | B63C 9/125 |
| 2020/0277033 | A1 * | 9/2020 | White | B63C 9/1255 |

FOREIGN PATENT DOCUMENTS

| | | | |
|---|---|---|---|
| WO | WO-2007/142887 | A1 | 12/2007 |
| WO | WO-2015/183470 | A2 | 12/2015 |
| WO | WO-2017/0049164 | A1 | 2/2017 |
| WO | WO-2018/213615 | A2 | 11/2018 |

OTHER PUBLICATIONS

Zobel et al., "Effects of the high-affinity corticotropin-releasing hormone receptor 1 antagonist R121919 in major depression: the first 20 patients treated," Journal of Psychiatric Research. 34(3):171-181 (2000).

International Search Report and Written Opinion for International Patent Application No. PCT/US2015/28912, dated Dec. 29, 2015 (21 pages).

International Preliminary Report on Patentability for International Patent Application No. PCT/US2015/028912, dated Nov. 1, 2016 (11 pages).

International Search Report and Written Opinion for International Patent Application No. PCT/US2018/033241, dated Aug. 13, 2018 (11 pages).

* cited by examiner

BUOYANCY GARMENT

BACKGROUND OF THE INVENTION

The stability and static trim of a swimmer affect the comfort and safety of the swimmer both at the surface and underwater during a dive. Underwater trim is at approximately neutral buoyancy, but surface trim may be at significant positive buoyancy.

Military personnel on swimming missions often have to carry additional gear and equipment. To increase buoyancy, the swimmer currently adds simple pieces of foam into one's clothing and gear. Often, the person needs to be able to transition smoothly and easily from water to land, or vice versa, and requires a garment that can be worn in and outside the water. Therefore, a garment that can be worn without restricting the person's movements is needed.

SUMMARY OF THE INVENTION

Featured is a personal flotation device that is a garment that can be worn by a wearer that includes one or more (e.g., two, three, four, five, six, seven, eight, nine, ten, fifteen, twenty, or more) inflatable bladders. In a first aspect, the personal flotation device includes the garment and a plurality of inflatable bladders, in which each of the bladders is attached to and disposed longitudinally on the garment and in substantially parallel orientation relative to each other, has a shape (e.g., a tubular shape) with a volume of between about 50 $cm^3$ to about 2,000 $cm^3$ (e.g., 50 to 100 $cm^3$, 50 to 250 $cm^3$, 50 to 500 $cm^3$, 50 to 750 $cm^3$, 50 to 1,000 $cm^3$, 50 to 1,250 $cm^3$, 50 to 1,500 $cm^3$, or 50 to 1,750 $cm^3$), and is configured to inflate in response to pressurized medium to form a pneumatic structure, and in which the garment includes at least one valve for inflating and/or deflating the bladders.

In a second aspect, featured is a method of using a personal flotation device (e.g., the personal flotation device of the first aspect) by donning a garment that contains a plurality of inflatable bladders. In an embodiment, each of the bladders is attached to and disposed longitudinally on the garment and in substantially parallel orientation relative to each other, has a shape (e.g., a tubular shape) with a volume of between about 50 $cm^3$ to about 2,000 $cm^3$ (e.g., 50 $cm^3$ to 100 $cm^3$, 50 to 250 $cm^3$, 50 to 500 $cm^3$, 50 to 750 $cm^3$, 50 to 1,000 $cm^3$, 50 to 1,250 $cm^3$, 50 to 1,500 $cm^3$, or 50 to 1,750 $cm^3$), and is configured to inflate in response to pressurized medium to form a pneumatic structure, and in which the garment includes at least one valve for inflating and/or deflating the bladders.

A third aspect features a kit that contains the personal flotation device of the first or second aspects and, optionally, one or more additional components (e.g., replacement parts) and/or instructions for use of the personal flotation device.

In some embodiments of any of the above aspects, the bladders are secured in pockets inside of the garment.

In some embodiments of any of the above aspects, the bladders are connected to a hand pump, a gas cartridge, or a component that contains a gas generating agent.

In some embodiments of any of the above aspects, the gas cartridge includes pressurized gas, for example, air, carbon dioxide, nitrogen, oxygen, and hydrogen, or is a non-flammable and/or inert gas.

In some embodiments of any of the above aspects, the bladders are connected through one or more flexible air lines.

In some embodiments of any of the above aspects, each bladder is configured to inflate to a pressure of at least about 10 psi to about 200 psi (e.g., 14-30 psi, 14-40 psi, 14-50 psi, 14-60 psi, 14-70 psi, 14-80 psi, 14-100 psi, 14-120 psi, 14-140 psi, 14-160 psi, 14-180 psi, or 14-200 psi).

In some embodiments of any of the above aspects, the valve is a check valve for inflating one or more of the bladders.

In some embodiments of any of the above aspects, the valve is a bleeder valve for deflating one or more of the bladders.

In some embodiments of any of the above aspects, the device further includes a bleeder valve for deflating one or more of the bladders.

In some embodiments of any of the above aspects, the valve is a check valve and a bleeder valve.

In some embodiments of any of the above aspects, one or more of the bladders have a diameter of less than about 5 cm, e.g., 4 cm, 3 cm, 2 cm, 1 cm, or 0.5 cm, or a diameter in the range of about 0.5 cm to about 5 cm.

In some embodiments of any of the above aspects, one or more of the bladders have a length of up to about 12 inches (e.g., 10 inches, 9 inches, 8 inches, 7 inches, 6 inches, 5 inches, 4 inches, 3 inches, 2 inches, or 1 inch, or a length in the range of about 1 to about 12 inches).

In some embodiments of any of the above aspects, the bladders are configured such that, when inflated, the bladders do not impede movement of a wearer donning the garment.

In some embodiments of any of the above aspects, the bladders are configured to be inflated and deflated together.

In some embodiments of any of the above aspects, bladders are configured to be inflated and deflated separately.

In some embodiments of any of the above aspects, the garment is configured to fit snugly around the wearer donning the garment.

In some embodiments of any of the above aspects, the bladders are located on the front, side, and/or back of the garment.

In some embodiments of any of the above aspects, the bladders are configured such that, when inflated, the bladders provide an increased buoyancy and an increased swimming efficacy for the wearer donning the garment.

Definitions

As used herein, the term "about" means+/−10% of the recited value.

The term "formfitting," as used herein, refers to a garment that is configured to fit snugly around a person wearing the garment.

BRIEF DESCRIPTION OF THE DRAWINGS

FIGS. 5A to 5C are a series of images showing shorts (20) with: (FIG. 5A) inflated bladders (2), (FIG. 5B) inflated bladders (2) and hand pump (8) connected to shorts (20), and (FIG. 5C) deflated bladders (2).

(FIG. 6A) shorts (20) with inflated bladders (2), and (FIG. 6B) shorts (20) with deflated bladders (2).

(FIG. 8A) front of deflated shirt (1) and inflated pants (10), and (FIG. 8B) back of deflated shirt (1) and inflated pants (10).

(FIG. 9A) inside of inflated front of pants (10), and (FIG. 9B) inside of inflated back of pants (10).

DETAILED DESCRIPTION

Figure 1:
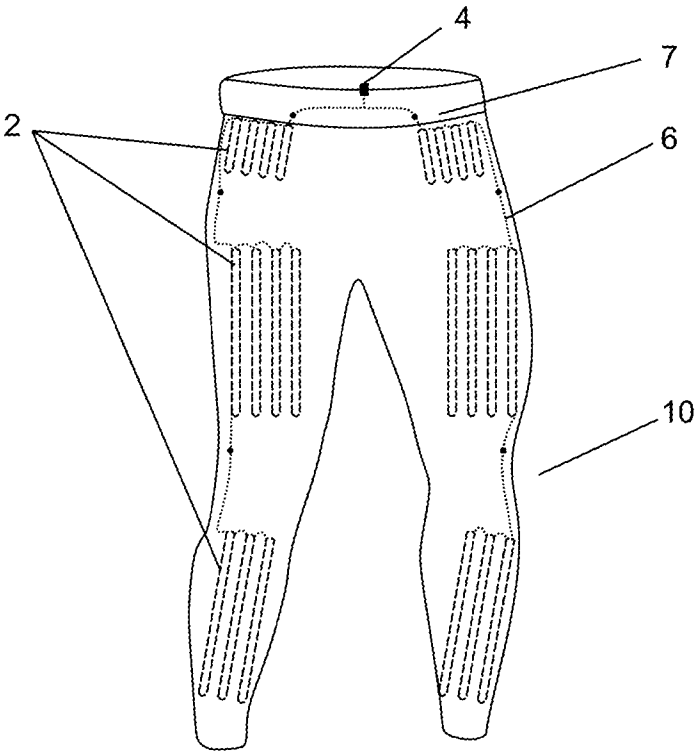
FIG. 1 is a schematic showing a garment of the invention in the form of pants (10), including bladders (2) that are secured in pockets in the inside of pants (10), inlet valve (4), which may be connected to a hand pump or a $CO_2$ source, valve housing and check valves (7), and flexible air lines (6) connecting bladders (2) to the hand pump or $CO_2$ source.

Featured is a garment that can be worn by an operator (e.g., a mammal, such as a human (e.g., military or civilian law enforcement personnel or an emergency first responder) or a dog) that includes inflatable bladders. When activated, the bladders of the garment inflate, thereby providing an increase in buoyancy to the wearer of the garment while swimming. Examples of such garments include pants, underpants, shorts, headgear, a skullcap, a glove, socks, shoes, a vest, a jacket, a shirt, an undershirt, an undergarment, or a full body suit. The garment can contain one or more bladders embedded throughout the garment (e.g., along a portion of the garment corresponding to the extremities (e.g., the arms and legs) or the torso (e.g., the chest, back, or groin) of the wearer.

When inflated, the bladders of the garment increase the buoyancy of the wearer, e.g., when swimming. Inflation of the bladders produces a garment that can assist the wearer with maintaining horizontal buoyancy (e.g., the wearer is parallel to the water surface) or vertical buoyancy (e.g., the wearer is perpendicular to the water surface).

The garments may be formfitting and/or can be made out of a variety of materials, such as elastic materials having a flexible structure.

The bladder(s) may be configured in the garment, such that, when inflated, they do not impede the wearer's ability to perform swimming maneuvers, such as the side stroke, back stroke, and freestyle.

Alternatively, the garment may provide buoyancy, for example, if used in a diving suit to keep an unconscious operator afloat.

Furthermore, the garment is designed with enhanced modularity, such that all components may be easily removed and replaced, as needed.

Before explaining the garment in detail, it is to be understood that the invention is not limited in its application to the details of construction and arrangement of parts illustrated in the accompanying description and drawings. The invention is capable of other embodiments and arrangements and of being practiced or carried out in various ways. Also, it is to be understood that the phraseology and terminology employed herein is for the purpose of description and should not be deemed limiting.

Bladders

The garment includes one bladder or a network of two or more, e.g., interconnected, bladders (e.g., 3, 4, 5, 6, 7, 8, 9, 10, 11, 12, 13, 14, 15, 16, 17, 18, 19, or 20, or more bladders) that are individually (or in groups) inflated and deflated. The bladder(s) can be contained in a pocket(s) in the garment, e.g., to prevent or limit the bladder(s) from moving (see, e.g., FIG. 1). The bladder(s) may include a valve housing and check valves (7) (FIG. 1) to facilitate the filling of the bladder(s) with a gas (e.g., air or $CO_2$) and the removal of the gas from the bladder(s). The garment may contain at least one valve for inflating and/or deflating all of the bladders, or multiple valves for inflating and/or deflating one or more of the bladders. The inflation of the bladder(s) of the garment may be triggered manually (e.g., by the wearer or by another person) or automatically (e.g., using a sensor that detects the need for increased buoyancy). The inflation of the bladders can also be activated by a trigger on the garment or remotely, e.g., using a wireless receiver (e.g., a Bluetooth or RF receiver).

Figure 4:
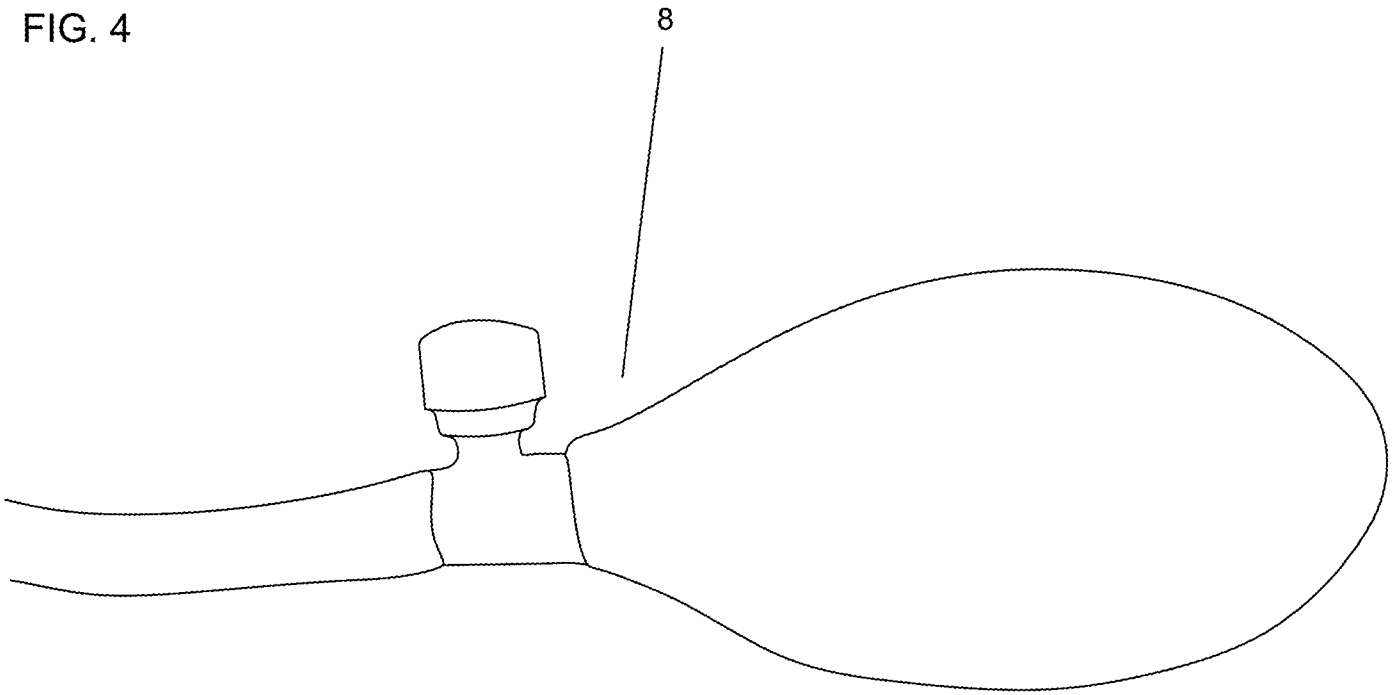
FIG. 4 is an image showing an example of hand pump (8).

For example, to inflate the bladders, a manual hand pump (such as those used in blood pressure measuring cuffs; see manual hand pump (8) in FIG. 4) or a $CO_2$ cartridge can be used. The pressure inside each inflated bladder can measure at least 10-200 psi, e.g., 14-30 psi, 14-40 psi, 14-50 psi, 14-60 psi, 14-70 psi, 14-80 psi, 14-100 psi, 14-120 psi, 14-140 psi, 14-160 psi, 14-180 psi, 14-200 psi, 1-30 psi, 1-40 psi, 1-50 psi, 1-60 psi, 1-70 psi, 1-80 psi, 1-100 psi, 5-30 psi, 5-40 psi, 5-50 psi, 5-60 psi, 5- 70 psi, 5-80 psi, 5-100 psi, 10-30 psi, 10-40 psi, 10-50 psi, 10-60 psi, 10-70 psi, 10-80 psi, or 10-100 psi. The volume of gas, e.g., $CO_2$ or air, within each inflated bladder can measure at least 50 to 2,000 $cm^3$, e.g., 50 to 100 $cm^3$, 50 to 250 $cm^3$, 50 to 500 $cm^3$, 50 to 750 $cm^3$, 50 to 1,000 $cm^3$, 50 to 1,250 $cm^3$, 50 to 1,500 $cm^3$, or 50 to 1,750 $cm^3$. In some embodiments, the check valve keeps the gas inside the bladders. A bleeder valve can be used to deflate the bladders. The check valve and bleeder valve may be separate units or they may a single component. The inflatable bladder elements, e.g., in pants (10) (FIG. 1) or shirt (1) (FIG. 2), may be configured so that they can be manually inflated and deflated, separately, or all at once.

Figure 6B:
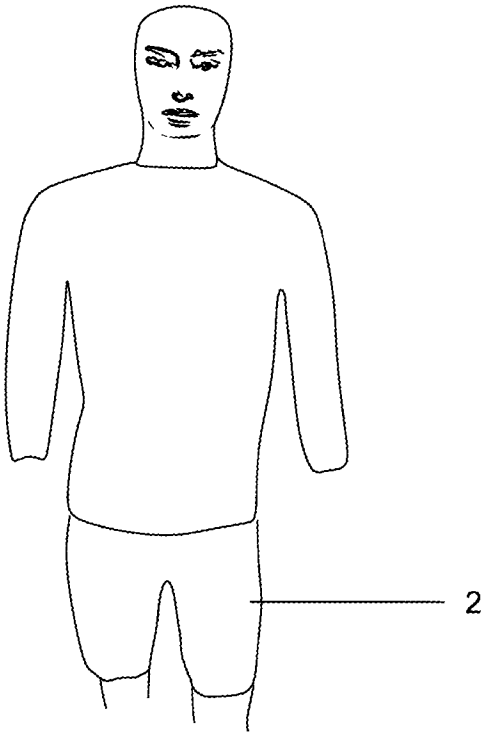
FIGS. 6A to 6B are a series of images showing.
Figure 6A:
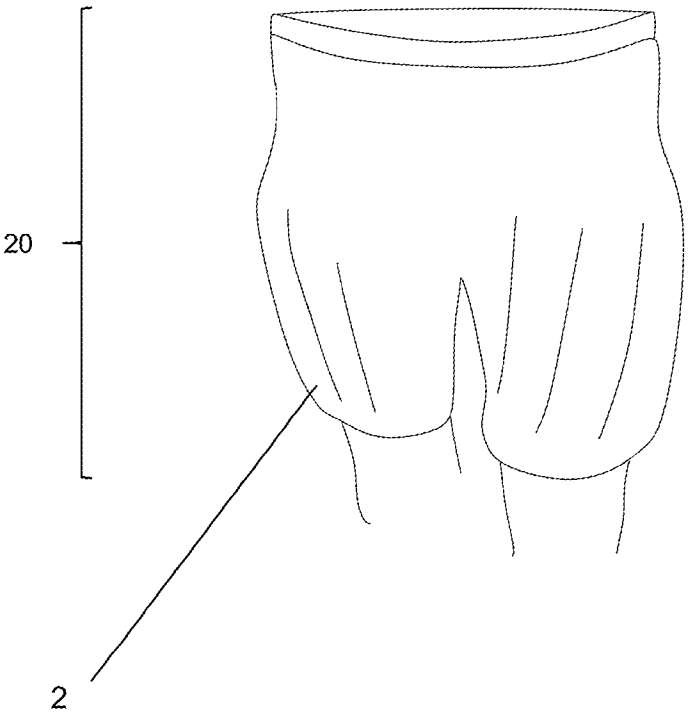

Bladders (2) may be integrated into a formfitting garment, such as a vest, a shirt, shorts, or pants. For example, shown in FIGS. 6A and 6B are shorts (20) that, when activated (e.g., inflated; FIG. 6A) or de-activated (e.g., deflated; FIG. 6B), do not impede the wearer's movements. The garments may increase the swimming efficiency of the wearer when in an inflated state. The garments can aid a swimmer to adjust their swimming trim, e.g., when carrying additional equipment and gear, such as, for example, during long distance swims.

A garment may include multiple bladders (e.g., a minimum of two), each of the bladders can be attached to and disposed longitudinally on the garment and/or in substantially parallel orientation relative to each other. The bladders can have a cylindrical (e.g., a tubular) shape, a spherical shape, a conical shape, a cuboid shape, or in the shape of a three, four, five, six, seven, eight, nine, or ten-sided square. The bladders can also be connected at the top of each bladder. For example, tubular-shaped bladders may be connected at the top of each bladder, thereby creating a set of bladders that is hand-like in shape.

When inflated, the bladders can have a diameter of less than 5 cm, e.g., 4 cm, 3 cm, 2 cm, 1 cm, or 0.5 cm, or a diameter in the range of 0.5-5 cm. In some embodiments, when inflated, the length of the bladders can measure up to 12 inches, e.g., 10 inches, 9 inches, 8 inches, 7 inches, 6 inches, 5 inches, 4 inches, 3 inches, 2 inches, or 1 inch, or a length in the range of 1-12 inches.

The bladders may be connected within a network, e.g., an interconnected network of tubing or similar structure, that is, e.g., connected to a single hand pump or gas canister, or each bladder may be separately connected to a hand pump or gas canister. A network of tubing may include flexible air lines. Any airtight or semi-airtight network of channels may function as a type of tubing, such as laminating or tightly weaving together two fabrics. The flow resistance in the network is equal to or higher than the forces required to inflate the bladders. This can ensure that the entire network of bladders will inflate.

The bladders may be made out of a flexible material, such as rubber, latex, polychloroprene, nylon fabric, or others. The bladders preferably display near-to-gastight properties. The bladders may be made of expandable materials that can expand, for example, up to 100× of their starting size (e.g., 90×, 80×, 70×, 60×, 50×, 40×, 30×, 20×, 10×, 9×, 8×, 7×, 6×, 5×, 4×, 3×, or 2× of their starting size).

In order to increase the buoyancy and swimming efficiency, with no or a minimal reduction in mobility of the wearer of the garment, the bladders can be discretely placed in various locations of the garment, e.g., pants and shirts. Exemplary locations are the front or the back of the garment, in pockets inside the outer layer of the garment. For example, bladders may be placed on the front and backside of the upper leg (i.e., quads), not covering the knee section and the sides of the upper leg, therefore allowing the wearer to use one's regular swimming strokes (such as side stroke) without impeding arm movement.

The outer layer of the garment may be capable of stretching. In some embodiments, when the operator deflates the bladders by opening a bleeder valve, the stretching outer layer forces the gas out of the bladders automatically.

Garment Configuration

In order to maximize the efficiency of the garment, the system may be integrated into several different configurations, such as into a full-body suit, a vest, a shirt, and pants. However, if desired, only selected areas of the body may be covered by the garment and/or bladders of a garment, e.g., the garment or bladders of a garment may cover only those areas of the body that assist in maintaining buoyancy, e.g., the torso, arms, and/or legs. Configuring the garment to cover only a select area of the body may reduce the weight and decrease the complexity of the garment.

The garment may be configured for human use and may include one or more functional layers, including, for example, the following: an inner and outer layer, and a pressure generating layer (on the body of the user) that includes the bladders. In some embodiments, the garment can further include one or more of the following: a microprocessing unit, a communication device, a GPS unit, a body sensor, valve arrays, a pressurized medium (e.g., gas) container, a gas generator, oral inflation tube (e.g., for manually inflating the bladder(s) by mouth; the oral inflation tube may include a check valve to prevent escape of air from the inflated bladder(s)), a pump (e.g., for manual or automatic inflation of the bladder(s)), and/or a power source. The garment can also include one or more of the features described in U.S. application Ser. No. 15/306,577, and U.S. Application No. 62/507,747, which are herein incorporated by reference.

Figure 7:
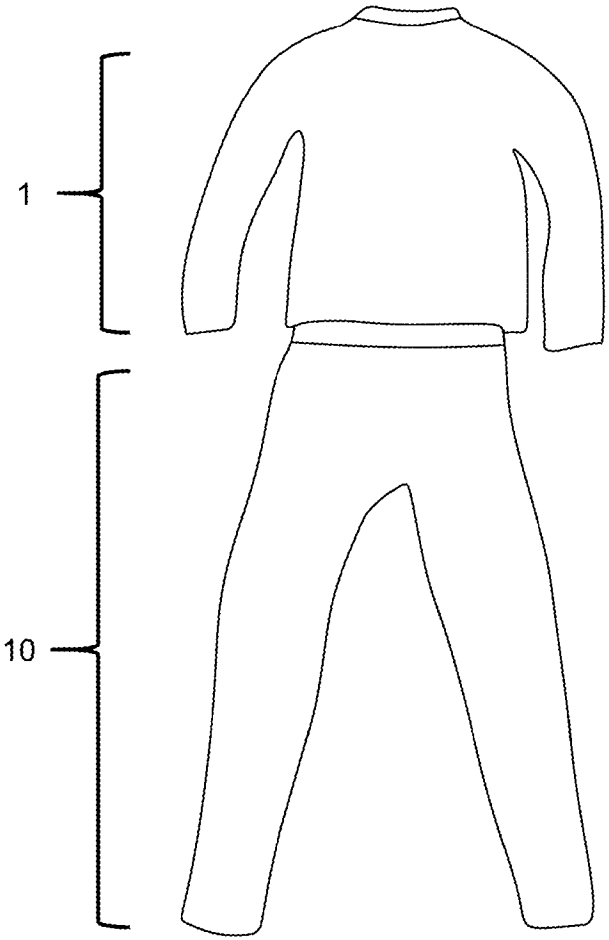
FIG. 7 is an image showing deflated shirt (1) and deflated pants (10).
Figure 8B:
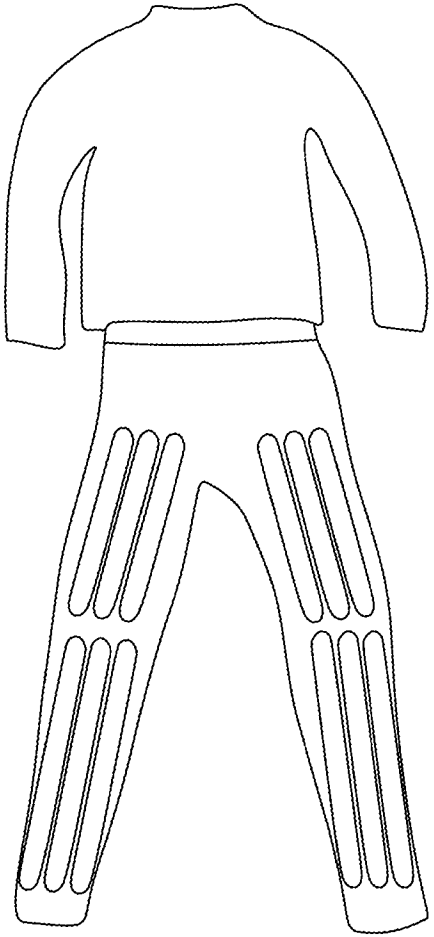
FIGS. 8A to 8B are a series of images showing.
Figure 8A:
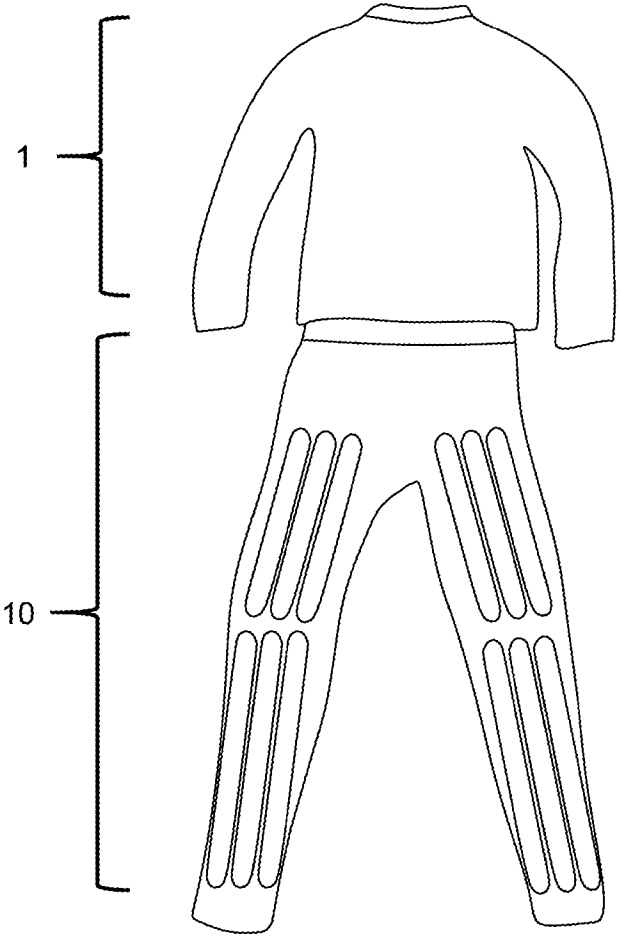
Figure 9B:
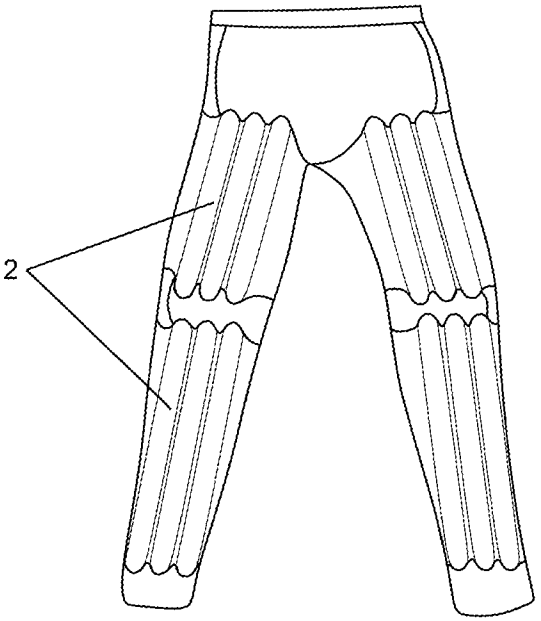
FIGS. 9A to 9B is a series of images showing.
Figure 9A:
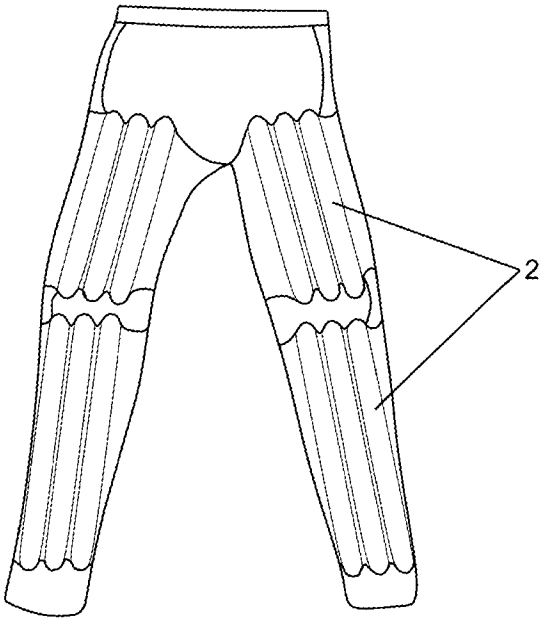
Figure 9A:
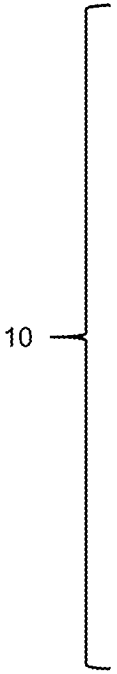

Examples for existing wearable clothing into which the present system could be incorporated include: watersport suits (e.g., wetsuits, swimwear, rash guards, diving suits), body armor (e.g., armored vest and/or suit), uniforms (e.g., combat uniforms; FIGS. 7A and 7B), and immersion survival suits.

The system may be tailored to provide a watertight seal around the neck or extremities (e.g., the cuffs of the arms and/or the ankles), to help a wounded and potentially unconscious wearer to stay afloat, and increase the chance of survival. The pressure applied around the neck and/or extremities may be, e.g., less than 11 psi, 5 psi, 2 psi, 1 psi, or 0.5 psi.

The inflation and valve system in place may ensure that during the inflation process the surface tension will never exceed the tensile strength of the bladder (i.e., to prevent the bladder from bursting).

The tube (or similar) network connecting the bladders may be flexible, to allow for adequate body movement. The pressurized medium, e.g., container may be connected to the bladder network via (one-way) valves. As with all the other systems, there may be at least one backup system. In the case of one additional system, the various regions of the network can be inflated from the main side, but also from the backup side. This is especially important, in case multiple impacts have occurred, crippling the feeding network.

The flow resistance of the network, the valves, the bladders, and the pressurized medium (e.g., gas) container are all engineered and balanced such that upon triggering the system, the bladders will inflate to a determined volume and/or pressure. In addition, inflation of the system will achieve buoyancy and stability and static trim, e.g., in either a vertical attitude at the water surface or horizontal attitude at the water surface.

There are different types of trim based on the location of the center of buoyancy. In stable trim, the center of buoyancy is directly above the center of gravity of the wearer. Any horizontal offset may generate a movement that will rotate the wearer until the equilibrium condition is restored. Several trims are possible for an upright wearer at the surface. An attitude can be stable when the center of buoyancy is nearer the head than the center of gravity, and on the same vertical line. Otherwise, the wearer may tend to rotate forwards or backwards until the center of buoyancy is directly above the center of gravity of the wearer. The lateral offset of center of buoyancy from center of gravity is generally insignificant unless the wearer has been weighted asymmetrically between the sides, and can occur when weights are ditched or lost from one side only. The offset in the forward or backward axis may be significant, and is usually the dominant factor in determining static trim attitude of a wearer. At the surface, it is generally undesirable to be trimmed strongly face down, but it may be useful to be able to trim face down at will. Vertical trim may be acceptable providing it can be overcome for swimming. There can be a conflict between the requirements for an appropriate surface trim and large reserve of buoyancy, particularly with back inflation systems, where a large volume is more likely to move the center of buoyancy further back than the center of gravity, and moving the center of gravity further back by shifting weights may compromise trim stability at neutral buoyancy.

Underwater trim is the wearer's attitude in the water, in terms of balance and alignment with the direction of motion. Accurately controlled trim can reduce swimming effort, as it may reduce the sectional area of the wearer passing through the water. The effect of swimming with a head-up angle, e.g., of about 15°, can be an increase in drag in the order of 50%. A slight head-down trim can reduce down thrust during finning, and reduce silting and fin impact with the bottom. A free-swimming wearer may need to trim erect or inverted at times, but in general, a horizontal trim has advantages both for reduction of drag when swimming horizontally, and for observing the bottom. A horizontal trim allows the wearer to direct propulsive thrust from the fins directly to the rear, which minimizes disturbance of sediments on the bottom. A stable horizontal trim requires that wearer's center of gravity is directly below the center of buoyancy (i.e., the centroid). Errors can be compensated, but large offsets may make it necessary for the wearer to constantly exert significant effort towards maintaining the desired attitude, if possible. Most of the control of trim available to the wearer is in the positioning of bladders that are inflated during use of the garment relative to other "weights" of the wearer (e.g., a backpack or other stowed gear worn by a wearer). Fine tuning of trim can be done by inflating one or more bladders along the length of the wearer to bring the center of gravity to a desired position.

Inner Layer

The inner layer of the garment is closest to the body of the wearer and provides a sufficient comfort level, e.g., including the ability to transfer body heat and moisture and to help keep the body at a comfortable temperature level. Any known garment can be used for this layer. For functional consideration, the layer is typically designed to be lightweight so as not to encumber the wearer (e.g., materials such as Spandex may be used). Synthetic fabrics that may be used in the garments include, but are not limited to, polyester, acrylic, nylon, rayon, spandex (e.g., LYCRA®, ELASPAN®, and ACEPORA®), GORE-TEX®, MEMBRAIN®, TEVENT®, HYVENT®, and KEVLAR®).

In regards to thermal properties, the design may consider the thermal insulation needs of the wearer. At low temperatures, the inner layer may allow the wearer to stay cool warm.

Outer Layer

The outer layer of the garment may include a durable material, such as a polymer mix, cloth (such as cotton, wool or others), leather, a next generation material, such as nano-fiber based material. or any material described for use as the inner layer of the garment. The outer layer may also be a water-resistant, water-repellant, or water-proof material. Also the garment may be designed to allow for a certain "stretch." The outer layer can also protect the inner layer from environmental influences. Depending on the overall design, the layers can be directly integrated into a garment or protective clothing (e.g., diving suit). Also, the outer garment may be chosen to act as body armor, e.g., it may be made out of high performance fibers, which offer ballistic protection. Examples include products from Kevlar, but also new materials, such as artificial spider silk, nanocomposites, and carbon fiber woven from carbon nanotubes. The device may also include pockets, e.g., that are designed to hold hard armor plates/ballistic plates. Armored garments are described, for example, in U.S. Pat. No. 5,443,882, herein incorporated by reference. The outer layer may contain pockets in which hard plastic or protective armor components may be placed. The outer layer may also be more heavily reinforced in more vulnerable areas (e.g., near the heart).

The outer layer may include straps, hooks, clips, zippers, Velcro® elements or similar, to allow for an easy adjustment and tightening of the garment to the body of the wearer. The outer layer may be easily removed from the remainder of the garment to make it easier to wash the various components of the garment or to repair and/or replace components, such as bladders, of the garment. The outer layer or another layer may be used to wrap the bladders for enhanced durability.

The outer layer can be made of an elastic material that maintains structural integrity while also permitting dynamic flexibility. The material allows for expansion upon inflation of the bladders of the garment. The material of the outer layer may be strong and durable.

The elastic material may have a high or low elastic modulus, depending on the material used. The material may have differential elastic properties in different areas of the material or device. For example, the elastic modulus may be lower around core and torso bladder(s), and higher and more flexible in the extremities that require more freedom of movement. The elastic material may be in part interwoven with the outermost layer of the device for enhanced elastic properties of the outermost shell and increased durability and ruggedness of the elastic layer.

Air Pump

The garment may include an air pump to inflate the bladders. By "air pump" is meant any device capable of pushing air. For example, centrifugal or positive displacement pumps. Centrifugal pumps produce flow by increasing the velocity of gas with a rotating vane impeller. Types of centrifugal pumps include radial, axial, and mixed flow. Positive displacement pumps operate by alternating of filling a cavity and then displacing a given volume of gas. Positive displacement pumps deliver a constant volume of gas for each cycle. Types of positive displacement pumps include reciprocating pumps (piston, plunger, and diaphragm), power pumps, steam pumps, and rotary pumps (gear, lobe, screw, vane, and peripheral and progressive cavity. Examples of air pumps that may be used in the garments include, but are not limited to, pumps such as the Lightweight Mini Air Pump (Kent International, Parsippany, N.J.), the Magic Air 12V Inflator/Deflator (Metro Vacuum, Oakland, N.J.), and the Stansport 12V Electric Air Pump (Stansport, Los Angeles, Calif.).

A hand pump (e.g., one used for blood pressure measuring cuffs) may also be used as the pump to inflate the bladders.

Pressurized Medium Container

The garments may also include a pressurized medium container, such as a compressed gas (e.g., air, carbon dioxide, nitrogen, oxygen, hydrogen, or other non-flammable gas and/or inert gas) cartridge for inflating the bladders instead of, or in addition to, a pump (e.g., a hand pump). The pressurized container may be attached to the garment or may be enclosed in a container separate from the garment (e.g., in a pack in close proximity to the garment). The cartridge actuation mechanism includes a triggering device that may be actuated to open the cartridge, such as by an actuation lever. The cartridge actuation mechanism can activate in response to a manual trigger or in response to a sensor (e.g., a sensor that can detect the need for increased buoyancy (e.g., a pressure sensor). Upon triggering the actuation mechanism, the cartridge will open, which allows the gas/compressed medium from the cartridge to inflate the buoyant layer, i.e., the bladders. The system may be provided with a deflation tube and a deflation valve.

When present, a gas cartridge may be secured to the garment, e.g., by a fabric loop fastened to the garment. The gas cartridge may be of conventional design, and includes those that are commercially available from a number of sources. While such cartridges come in a variety of sizes, the garment may utilize one or two cartridges, e.g., of the 16 gram net contents weight size.

When present, the cartridge may be removably coupled (e.g., by a threaded fitting) to a cartridge actuation mechanism. The actuation mechanisms may be of conventional design; several are commercially available from a number of sources. For example, if a 16 gram cartridge is used, the actuation mechanism may be the Model 840AM (Halkey- Roberts, St. Petersburg, Fla.), or the equivalent. The actuation mechanism may include a triggering device that includes an actuation lever that is detachably connected to a spring-loaded pin or rod, which is installed in the actuation mechanism to rupture the neck of the cartridge when the lever is pulled with a force of predetermined magnitude, thereby opening the cartridge. The cartridge may be connected to inflation tubes and valve arrays, which direct the flow of gas to the bladder system. When a cartridge is opened, gas from the open cartridge may pass through its associated inflation tubes and valves, and into the predetermined bladders to inflate them.

The pressurized gas cartridge may be housed in a removable container. For example, the gas cartridge may be connected to a piercing pin, which pierces through the sealed cartridge upon activation to initiate gas flow. The gas passes through a pressure regulator which maintains the different pressure levels on each side of the pressure regulator. The pressure regulator may be a two stage pressure regulator. For example, the $CO_2$ cartridge may have a pressure of 900 psi while the pressure is reduced to 50-200 psi (e.g., 100 psi) in the first stage and then to 5-50 psi (e.g., 40 psi) in the second stage. The pressure regulator may be a non-relieving pressure regulator (e.g., no gas is vented out in order to maintain the pressure). After the pressure regulator the gas flows through a main shut off valve, such as a solenoid valve. The solenoid valve may remain closed so as to maintain the differential pressures on each side of the pressure regulator. The gas then flows to the outlets connected to the tubes that are integrated into the garment in order to inflate the bladders. The garment may be configured to inflate only a subset of bladders. If so, the pressure regulator may have a micro servo that rotates the valve in position to direct the gas flow to the correct outlet, which is connected only to a subset of bladders to be inflated.

Gas Generator

In some embodiments, the garment includes a gas generator (instead of or in addition to the previously described compressed medium container). The gas generator can be a precursor for generating a gas (e.g., carbon dioxide, nitrogen, hydrogen, oxygen, or other non-flammable and/or inert gas) to trigger the inflation of the bladders. Examples of gas generating agents are described in, e.g., PCT Publication No. WO2012141578 and PCT Publication No. WO 03/009899, incorporated herein by reference.

By applying a gas generator comprising a precursor for generating gas, an assembly can be provided in which the gas generator can be given a relatively compact form compared to other volume-generating means. A cool gas generator (i.e., one that operates at or near room temperature) may be able to provide a high gas volume relative to the size, weight and/or volume of the gas generator. A further advantage of such a gas generator is that it can be stored for a long period, (e.g., up to 10 years or longer), after which period it still functions, and can be activated in the usual manner.

The gas generated may be a low reactivity or inert gas, such as nitrogen, carbon dioxide, or other non-flammable and/or inert gas, or a moderately reactive gas, such as oxygen or hydrogen. Examples of gas-generating precursors used include, but are not limited to, alkali metal chlorates and alkali metal perchlorates, in particular lithium perchlorate ($LiClO_4$), lithium chlorate ($LiClO_3$), sodium perchlorate ($NaClO_4$), sodium chlorate ($NaClO_3$), potassium perchlorate ($KClO_4$) or potassium chlorate ($KClO_3$), peroxides, in particular sodium peroxide ($Na_2O_2$) and potassium peroxide ($K_2O_2$), superoxides, in particular potassium superoxide ($KO_2$) and sodium superoxide ($NaO_2$), and others known in the art.

The gas generator may be a gas-forming substance that can be actuated by, e.g., mechanical or electrical energy. In particular, the unit may be configured for automatic actuation of the process of gas formation. The initiation assembly in the gas generator may contain a biasing mechanism, such as a spring, and/or an electric mechanism, or may utilize a chemical reaction, such as a soluble tablet that releases gas upon hydration.

In other embodiments, the gas generator acts via a pump, such as devices available by Sensidyne, St. Petersburg, Fla. (e.g., Sensidyne Diaphragm Micro Air Pumps) and Schwarzer Precision, Essen, Germany (e.g., Rotary Diaphragm Pumps), which generate pressure and volume sufficient to inflate the bladders.

Valve System

The garments may include a valve system. The valves may connect the hand pump, a compressed medium (e.g., gas) container, and/or the gas generator to inflation tubes and/or to the bladders. In some embodiments, the garment includes mainly one-way valve systems. The valves may be electrically activated to allow for a flow of medium (e.g., gas). They may be powered by an energy unit, such as a battery pack, or engaged manually.

The valve may be a check valve for inflating and/or deflating one or more of the bladders. The valve may be a bleeder valve for deflating one or more of the bladders. The valve may be a check valve and a bleeder valve. The garment may have several valves, which may be the same or different.

A flow restrictor may be used instead of, or in addition to, a valve. A flow restrictor can be a thin tube, through which gas is forced (e.g., air or $CO_2$) at a pressure of about 100 psi. The bladder can inflate (e.g., the gas pressure is between about 1 psi and 500 psi, e.g., 100 psi, 90 psi, 80 psi, 70 psi, 60 psi, 50 psi, 40 psi, 30 psi, 20 psi, 10 psi, 9 psi, 8 psi, 7 psi, 6 psi, 5 psi, 4 psi, 3 psi, 2 psi, or 1 psi) and stay inflated for hours (e.g., 24 hours, 23 hours, 22 hours, 21 hours, 20 hours, 19 hours, 18 hours, 17 hours, 16 hours, 15 hours, 14 hours, 13 hours, 12 hours, 11 hours, 10 hours, 9 hours, 8 hours, 7 hours, 6 hours, 5 hours, 4 hours, 3 hours, 2 hours, or 1 hour) or less than an hour (e.g., 5-45 minutes). The flow restrictor acts as a type of one-way valve. The setup can allow for a flow restrictor to be placed in series with the gas cartridge and inflatable bladder. Multiple adjacent bladders promote redundancy, such that, if one bladder were to fail, an adjacent one could fill in. The bladders are also designed to be removable in case they are damaged. Then, a new bladder can be modularly added back into the garment to replace the dysfunctional or damaged bladder.

The valve and flow restrictor system optimizes the rate and time it takes to fill the bladders upon activation. For example, the system may be configured to efficiently inflate upon triggering from a stimulus, e.g., manual activation. Although, the system can be configured not to inflate too fast in order to prevent overwhelming the bladders and causing a rupture. Thus, the valves and flow restrictors may maintain a balance of flow rate. The bladders may take less than 1 minute to inflate (e.g., 50 seconds, 40 seconds, 30 seconds, 20 seconds, or 10 seconds) or less than 10 seconds to inflate (e.g., 9 seconds, 8 seconds, 7 seconds, 6 seconds, 5 seconds, 4 seconds, 3 seconds, 2 seconds, or 1 second). The valves and flow restrictors can be used to achieve a desired rate of inflation (e.g., 1000 $cm^3$/sec, 900 $cm^3$/sec, 800 $cm^3$/sec, 700 $cm^3$/sec, 600 $cm^3$/sec, 500 $cm^3$/sec, 400 $cm^3$/sec, 300 $cm^3$/ sec, 200 $cm^3$/sec, 100 $cm^3$/sec, 90 $cm^3$/sec, 80 $cm^3$/sec, 70 $cm^3$/sec, 60 $cm^3$/sec, 50 $cm^3$/sec, 40 $cm^3$/sec, 30 $cm^3$/sec, 20 $cm^3$/sec, 10 $cm^3$/sec, 9 $cm^3$/sec 8 $cm^3$/sec, 7 $cm^3$/sec, 6 $cm^3$/sec, 5 $cm^3$/sec, 4 $cm^3$/sec, 3 $cm^3$/sec, 2 $cm^3$/sec, or 1 $cm^3$/sec).

Manual Triggering Mechanism

The garment can have a manual triggering mechanism, such as a rip cord or similar structure, which allows the wearer to open the valve(s). Manual triggering may lead to inflation of all bladders, e.g., to increase buoyancy, or only a subset of bladders. The triggering mechanism may be, e.g., the Model 840AM (Halkey-Roberts, St. Petersburg, Fla.), or an equivalent.

In case of malfunctioning or damage of the compressed medium container, the wearer can manually trigger the inflation of the bladders via an additional inlet valve, which can be used as an inlet for inflation by pump or orally.

Inlet for Manual Inflation

Referring to FIG. 1, the garment (e.g., pants (10)) includes inlet (4) for manual inflation. In case of malfunctioning of the pressurized medium system, or the gas generator, the wearer can manually inflate the bladders. This can be done by using an external pump, or by orally "blowing" into the inlet valve. Examples of this type of component may be the model V73000 (Halkey-Roberts, St. Petersburg, Fla.), which includes a breather tube and relief valve with dust cap, which is designed for applications requiring oral filling and pressure relief for overpressure protection, or the equivalent.

The garment can also be manually deflated through the same or a different valve.

Uses

The garment can be donned by a wearer and, when inflated, provides an increase in buoyancy during swimming or diving. A wearer dons the garment, e.g., pants (10) (FIG. 1) and shirt (1) (FIG. 2), and enters a body of water. When the wearer begins to swim, he/she realizes there is not enough buoyancy on his/her top. He/she inflates one or more of the bladders (2) connected through flexible air lines (6) using the inlet valve (4) to achieve a leveled vertical trim. For example, to inflate the bladders (2), the wearer can use a hand pump (8) (FIG. 4). Alternatively, the bladders (2) can be filled using a compressed gas, e.g., $CO_2$. The pressure inside each inflated bladder can measure at least 10-200 psi, e.g., 14-30 psi, 14-40 psi, 14-50 psi, 14-60 psi, 14-70 psi, 14-80 psi, 14-100 psi, 14-120 psi, 14-140 psi, 14-160 psi, 14-180 psi, or 14-200 psi. The volume of gas, e.g., $CO_2$ or air, within each inflated bladder can measure at least 50 to 2,000 $cm^3$, e.g., 50 to 100 $cm^3$, 50 to 250 $cm^3$, 50 to 500 $cm^3$, 50 to 750 $cm^3$, 50 to 1,000 $cm^3$, 50 to 1,250 $cm^3$, 50 to 1,500 $cm^3$, or 50 to 1,750 $cm^3$. Once the swim or dive is complete, and the wearer no longer needs the buoyancy, he/she can deflate the bladders (2) by manually opening a valve (4). Alternatively, the valve (4) can be automatically opened when the wearer exits the body of water, causing bladder deflation.

Kits

A garment and components thereof for use in increasing buoyancy, e.g., while swimming or diving, described herein can be provided in a kit. Kits may include a one or more (e.g., 3, 4, 5, 6, 7, 8, 9, 10, 11, 12, 13, 14, 15, 16, 17, 18, 19, or 20, or more) bladders, one or more (e.g., 3, 4, 5, 6, 7, 8, 9, 10, 11, 12, 13, 14, 15, 16, 17, 18, 19, or 20, or more) flexible air lines connecting to bladders, one or more (e.g., 2, 3, 4, 5, or more) inlet valves, one or more hand pumps (e.g., 2, 3, 4, 5, or more), and/or one or more compressed gas cartridges (e.g., air, carbon dioxide, nitrogen, oxygen, hydrogen, or a non-flammable and/or inert gas) described herein. The bladders, flexible air lines connecting to bladders, inlet valves, hand pumps and/or compressed gas cartridges in a given kit can be sold separately or together with a garment. Additional bladders, flexible air lines connecting to bladders, inlet valves, hand pumps and/or compressed gas cartridges can be sold separately as replacement parts in case any of these components break. Kits may include one or more (e.g., 2, 3, 4, 5, or more) of the garments (pants, underpants, shorts, headgear, a skullcap, a glove, socks, shoes, a vest, a jacket, a shirt, an undershirt, an undergarments, or a full body suit). The kit can further include a package insert that instructs a user of the kit how to use the garment according to the methods described herein and/or how to replace one or more components of the garment.

EXAMPLES

The following examples are to illustrate the invention. They are not meant to limit the invention in any way.

Example 1

Figure 2:
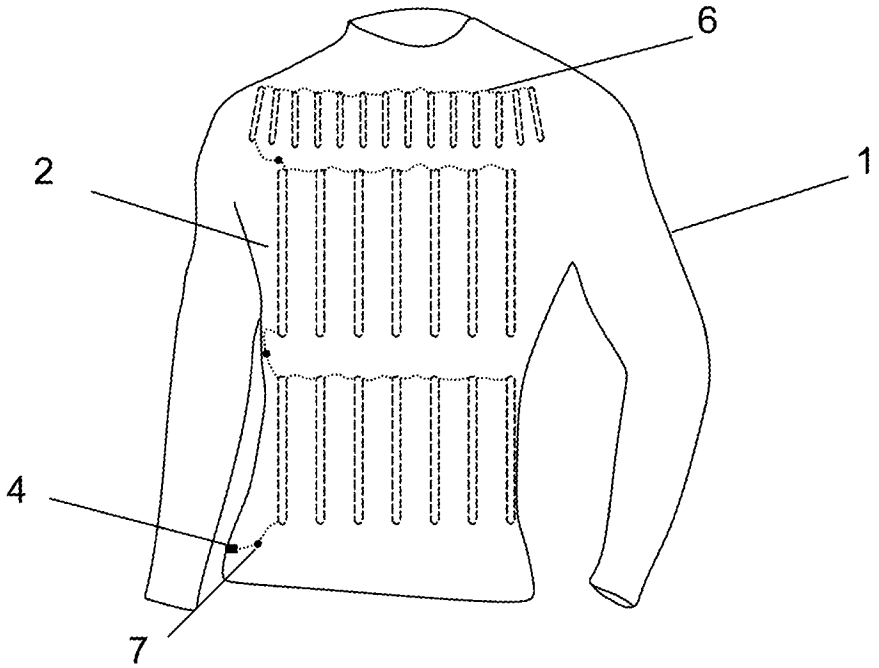
FIG. 2 is a schematic showing a garment of the invention in the form of shirt (1), including bladders (2) secured in pockets in the inside of the shirt (1), inlet valve (4), which may be connected to a hand pump or a $CO_2$ source, valve housing and check valves (7), and flexible air lines (6) connecting bladders (2) to the hand pump or $CO_2$ source.
Figure 3:
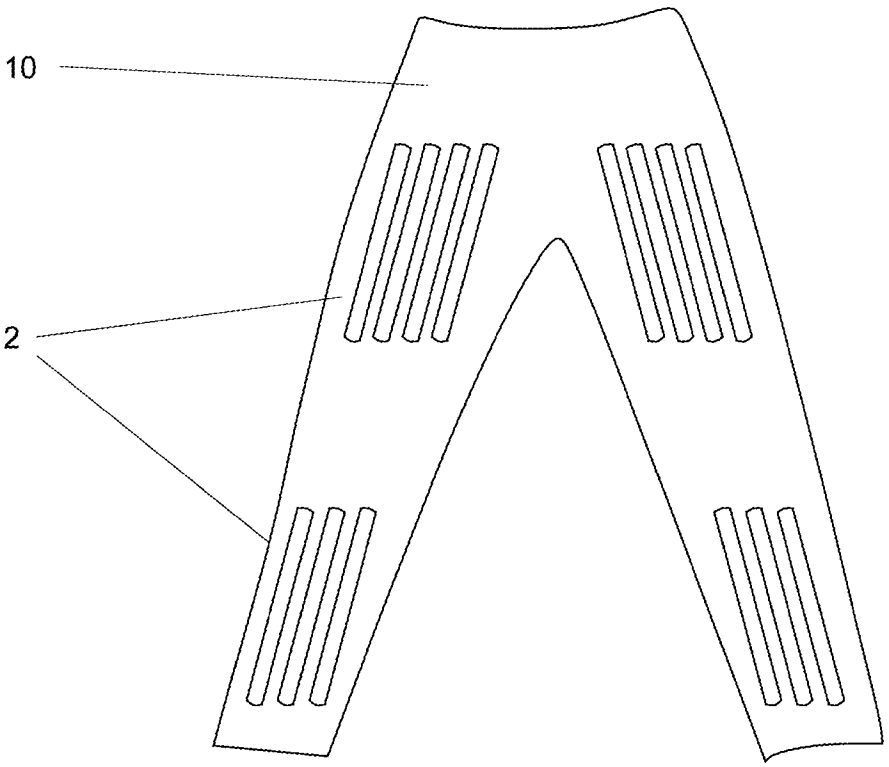
FIG. 3 is an image showing pants (10) with two sets of bladders (2) attached to each leg.

A military person on a swimming mission needs to carry gear and equipment. The person wears a shirt (FIG. 2) and pants (FIG. 3) that include multiple bladders. Referring to FIG. 2, bladders (2) on shirt (1) are located on the chest (e.g., two rows of seven bladders each) and back portion of the garment (e.g., two rows of 10 bladders each). Bladders (2) are connected through flexible lines (6) to one another and to a $CO_2$ cartridge. Referring to FIG. 3, bladders (2) on pants (10) are located on the shins (e.g., three bladders each), calves (e.g., three bladders each), and front and back of the thighs (e.g., four bladders each). Before entering the water, the operator inflates the bladders using a $CO_2$ cartridge. Each bladder inflates to about 10-30 psi (e.g., about 15 psi). The garment increases the buoyancy of the person and helps to establish a correct trim in the water.

Example 2

Figure 5C:
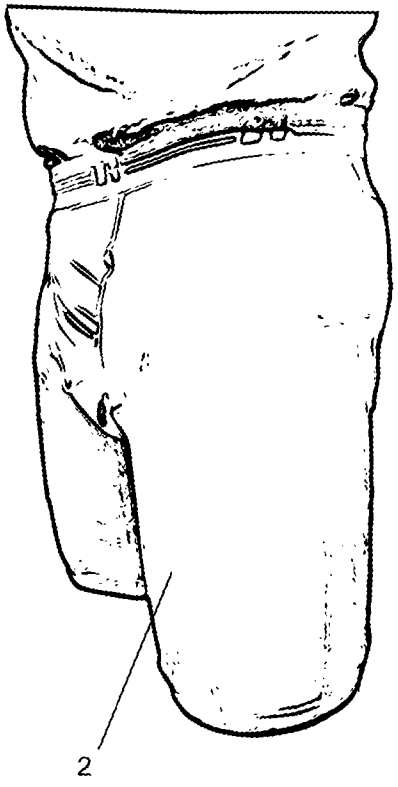
Figure 5B:
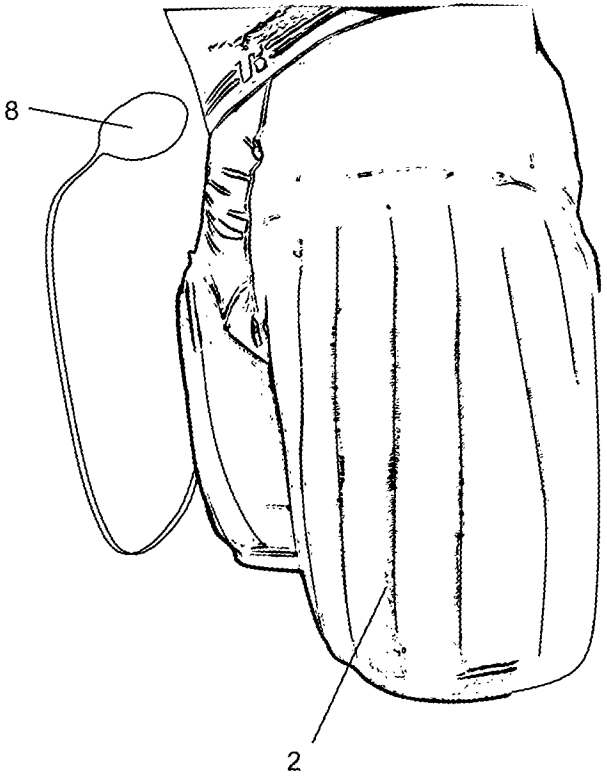
Figure 5A:
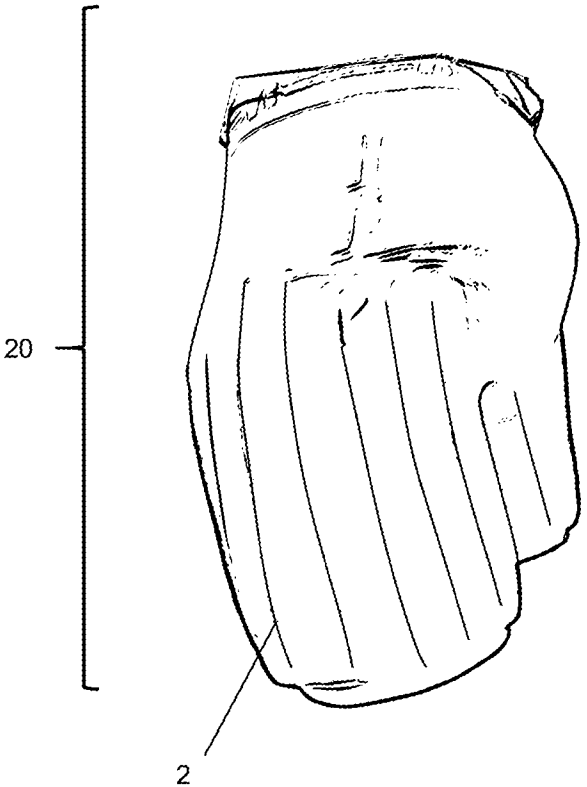

Referring to FIG. 5A-5C, a diver wearing shorts (20) with four bladders (2) in the front and back of each leg inflate the bladders using hand pump (8). Inflated bladders (2) on the garment increase the buoyance forces, and raise the diver to the water surface. When finished, bladders (2) can be manually deflated.

Other Embodiments

All publications, patents, and patent applications mentioned in the above specification are hereby incorporated by reference to the same extent as if each individual publication, patent or patent application was specifically and individually indicated to be incorporated by reference in its entirety. Various modifications and variations of the described methods, pharmaceutical compositions, and kits of the invention will be apparent to those skilled in the art without departing from the scope and spirit of the claimed invention. Although the disclosure has been described in connection with specific embodiments, it will be understood that it is capable of further modifications and that the invention as claimed should not be unduly limited to such specific embodiments.

The invention claimed is:

1. A personal flotation device comprising a garment and a plurality of inflatable bladders, each of which is attached to and disposed longitudinally on the garment and in substantially parallel orientation relative to each other, has a shape with a volume of between about 50 to about 2,000 $cm^3$, and is configured to inflate in response to pressurized medium to form a pneumatic structure; wherein the garment comprises at least one valve for inflating and/or deflating the bladders, and wherein one or more of the plurality of inflatable bladders is configured to be individually inflated or deflated along a length of the garment, whereby the device is configured to control a trim and/or a center of gravity of a user wearing the garment.

2. The device of claim 1, wherein the bladders are secured in pockets inside of the garment.

3. The device of claim 1, wherein the bladders are connected to a hand pump or a gas cartridge.

4. The device of claim 3, wherein the gas cartridge comprises pressurized gas and is selected from the group consisting of air, carbon dioxide, nitrogen, oxygen, and hydrogen, or is a non-flammable and/or inert gas.

5. The device of claim 1, wherein the bladders are connected through one or more flexible air lines to each other.

6. The device of claim 1, wherein each bladder is configured to inflate to a pressure of at least about 10 to about 200 psi.

7. The device of claim 1, wherein the valve is a check valve for inflating one or more of the bladders.

8. The device of claim 1, wherein the valve is a bleeder valve for deflating one or more of the bladders.

9. The device of claim 7, wherein the device further comprises a bleeder valve for deflating one or more of the bladders.

10. The device of claim 1, wherein the valve is both a check valve and a bleeder valve.

11. The device of claim 1, wherein one or more of the bladders have a diameter of less than about 5 cm.

12. The device of claim 1, wherein one or more of the bladders have a length of up to about 12 inches.

13. The device of claim 1, wherein the bladders are configured such that, when inflated, the bladders do not impede movement of a user wearing the garment.

14. The device of claim 1, wherein the bladders are configured to be inflated and deflated together.

15. The device of claim 1, wherein bladders are configured to be inflated and deflated separately.

16. The device of claim 1, wherein the garment is configured to fit snugly around the user wearing the garment.

17. The device of claim 1, wherein the bladders are located on the front and/or back of the garment.

18. The device of claim 1, wherein the bladders are configured such that, when inflated, the bladders provide an increased buoyancy and an increased swimming efficacy for the user wearing the garment.

19. The device of claim 1, wherein the bladders have a tubular shape.

20. A method of optimizing a trim and center of gravity of a user using the personal flotation device of claim 1, the method comprising donning the garment and individually inflating or deflating one or more of the plurality of inflatable bladders along the length of the user, thereby controlling the trim and/or the center of gravity of the user.

21. The method of claim 20, wherein the bladders are secured in pockets inside of the garment.

22. The method of claim 20, wherein the bladders are connected to a hand pump or a gas cartridge.

23. The method of claim 22, wherein the gas cartridge comprises pressurized gas and is selected from the group consisting of air, carbon dioxide, nitrogen, oxygen, and hydrogen, or is a non-flammable and/or inert gas.

24. The method of claim 20, wherein the bladders are connected through one or more flexible air lines to each other.

25. The method of claim 20, wherein each bladder is configured to inflate to a pressure of at least about 10 to about 200 psi.

26. The method of claim 20, wherein the valve is a check valve for inflating one or more of the bladders.

27. The method of claim 20, wherein the valve is a bleeder valve for deflating one or more of the bladders.

28. The method of claim 26, wherein the device further comprises a bleeder valve for deflating one or more of the bladders.

29. The method of claim 20, wherein the valve is both a check valve and a bleeder valve.

30. The method of claim 20, wherein one or more of the bladders have a diameter of less than 5 cm.

31. The method of claim 20, wherein one or more of the bladders have a length of up to 12 inches.

32. The method of claim 20, wherein the bladders are configured such that, when inflated, the bladders do not substantially impede movement of the user.

33. The method of claim 20, wherein the bladders are configured to be inflated and deflated together.

34. The method of claim 20, wherein bladders are configured to be inflated and deflated separately.

35. The method of claim 20, wherein the garment is configured to fit snugly around the user.

36. The method of claim 20, wherein the bladders are located on the front and/or back of the garment.

37. The method of claim 20, wherein the bladders are configured such that, when inflated, the bladders provide an increased buoyancy and an increased swimming efficacy for the user.

38. The method of claim 20, wherein the bladders have a tubular shape.

39. A kit comprising the personal flotation device of claim 1.

* * * * *